United States Patent [19]

Kurz

[11] 4,164,194

[45] Aug. 14, 1979

[54] ANCHOR BRACKET

[76] Inventor: John C. Kurz, 1250 Grant Ave., Philadelphia, Pa. 19115

[21] Appl. No.: 823,743

[22] Filed: Aug. 11, 1977

[51] Int. Cl.[2] ..... B63B 21/22

[52] U.S. Cl. ..... 114/210; 114/221 R

[58] Field of Search ..... 211/13; 248/309 R, 110; 114/210, 221 R; 9/1.7, 2 S

[56] References Cited

U.S. PATENT DOCUMENTS

| | | | |
|---|---|---|---|
| 2,705,467 | 4/1955 | Ogg et al. | 114/221 R |
| 3,916,468 | 11/1975 | Tetreault et al. | 9/2 S |
| 3,974,793 | 8/1976 | Aring | 114/210 |
| 3,991,699 | 11/1976 | Bass | 114/210 |

*Primary Examiner*—Trygve M. Blix
*Assistant Examiner*—Sherman D. Basinger
*Attorney, Agent, or Firm*—Weiser, Stapler & Spivak

[57] ABSTRACT

An anchor bracket for suspending the anchor of a power boat above the deck comprising a base support which is affixed directly to the deck of the boat and an upper lock which is spaced from the base support. The base support and upper lock respectively engage the anchor pivot bar and the anchor shank to secure the anchor in position above the boat deck.

5 Claims, 6 Drawing Figures

ANCHOR BRACKET

BACKGROUND OF THE INVENTION

The present invention relates generally to the field of boating equipment, and more particularly is directed to a novel anchor bracket suitable to support an anchor upon the deck of a boat.

An anchor generally can be considered as a heavy weight that is traditionally used to hold a boat or ship in a desired location, such as near shore, in a harbor, in a predetermined fishing area, etc. Most common anchors are made of iron or steel, or other heavy material and a rope or chain of suitable length is employed to fasten the anchor to the boat or ship. When the anchor is lowered to the bottom of the water, it is designed to catch in the mud to hold the vessel in place.

In the case of small boats, such as row boats, outboard motor boats, inboard motor boats and the like, several types of anchors are in common use. Such anchors include a cement can anchor, which is a cylindrically shaped mass of cement with an imbedded ring protruding from the top and the mushroom type of anchor, which comprises essentially a cast iron bowl fastened on the end of shank. In the case of larger and more expensive boats, such as power cruisers, the stockless type of anchor is most commonly employed. The stockless anchor comprises a shank having a ring at one end and which is equipped with the flukes and a crown at the other end. The flukes generally are pivoted relative to the shank and the anchor acts to hold the boat in place when the flukes dig into the ocean bottom. A rope or chain is attached to the anchor ring and interconnects the anchor to the boat. When it is desired to get under way, the entire length of the anchor chain or rope is pulled into the boat together with the anchor itself.

It is now the common practice to simply place the anchor upon the deck of the boat near the bow thereof when it is pulled out of the water. Once placed upon the deck, the very weight of the anchor itself serves to maintain the anchor in position until it is again desired to hold the boat in place, at which time, the anchor is again thrown into the water and the rope or chain is played out until the anchor contacts the bottom.

While the above procedures are almost universally followed in the pleasure boating industry, such procedures have the drawback of placing a rather cumbersome, ungainly and sometimes dangerously sharp metallic object directly upon the deck of a boat in such a manner as to effectively reduce deck space and to prevent beneficial use of the deck area that is encumbered by the anchor itself.

SUMMARY OF THE INVENTION

The present invention relates generally to the field of boat anchor supports, and more particularly, is directed to an anchor bracket including a pair of split construction elements capable of supporting an anchor above the deck of a boat.

The anchor bracket of the present invention includes a base support which is generally channel shaped in configuration and which is affixed with the web or flanges thereof arranged parallel to and affixed directly to the deck of the boat. fThe legs of the base support face upwardly, in spaced relationship and generally define an angle of ninety degrees with the deck of the boat. The base support legs each include a medially positioned transverse slot of suitable width and depth to act as a cradle to receive the pivot bar of an anchor therein in a supporting arrangement. The support legs of the base support and the cradle slots provided therein carry the entire weight of the anchor and support the anchor in spaced relationship above the deck of the boat. Thus, only the base support itself contacts the boat deck and no portion of the anchor rests upon or engages the deck, thereby leaving substantially the entire deck, at the anchor resting area unobstructed and free for other activities.

The anchor bracket also includes a spaced upper lock which preferably is carried in vertical registry above the base support. In a preferred embodiment, the upper lock is affixed to the usual boat handrail or guardrail in a stationary manner to receive and support the anchor shank in a generally vertical alignment above the base support.

The upper lock comprises a body which preferably is fabricated to a generally U-shaped configuration wherein the body base or web is affixed to the boat handrail in known manner. A pair of legs extend from the body base and project toward the stern in substantial registry over the base support cradles. The opening or slot which is defined between the upper lock legs receives the anchor shank therein and secures the anchor shank in generally vertical alignment. A hinged closure pivotally affixes to one of the upper lock legs in a manner whereby the closure can be pivoted between an open position and a closed position in a relatively easy manner to either expose the upper lock slot for placement of the anchor shank therein or to lock the anchor shank within the upper lock slot when the anchor is pulled from the water and is positioned upon the base support.

The split anchor bracket components comprising the base support and upper lock cooperate to carry the weight of the anchor entirely clear of the boat deck and to support the anchor shank in generally vertical alignment whereby a minimum amount of deck space is encumbered by the anchor. The deck can be readily cleaned of mud, silt, sand, etc. when the anchor is pulled from the water bottom as a result of the spacing between the anchor and the deck provided by the base support.

It is therefore an object of the present invention to provide an improved anchor bracket of the type set forth.

It is another object of the present invention to provide an anchor bracket means capable of supporting an anchor above the deck of a boat in a predetermined disposition.

It is another object of the present invention to provide a novel split anchor bracket comprising generally a base support which is affixed to the deck of a boat and an upper lock which is spaced upwardly from the base support and which includes locking means to lock the shank of an anchor in generally vertical alignment.

It is another object of the present invention to provide a novel split anchor bracket comprising generally a channel shaped base support wherein the flanges of the base support are affixed to the deck of boat and wherein the legs of the base support are treated to provide a transverse cradle within which a portion of the anchor is supported above the deck and which further comprises an upper lock of generally U-shaped configuration wherein the shank of the anchor is locked within the space defined between the legs of the U.

It is another object of the present invention to provide a novel anchor bracket comprising base support means affixed to the deck of a boat, upper lock means spaced above the base support means and generally in vertical registry over the base support means, said upper lock means further including hinged closure means to secure the shank of a anchor therewithin when the base support is utilized to support and carry the anchor above the deck of the boat.

It is another object of the present invention to provide a novel split anchor bracket that is simple in design, inexpensive in manufacture and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENTS OF THE INVENTION

Figure 1:
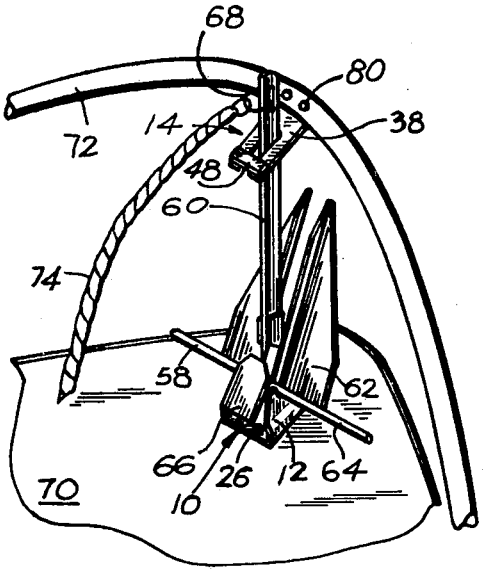
FIG. 1 is a perspective view showing the anchor bracket of the present invention supporting an anchor above the deck of a boat.

Although specific terms are used in the following description for the sake of clarity, these terms are intended to refer only to the particular structure of the invention selected to illustration in the drawings and are not intended to define or limit the scope of the invention.

Referring now to FIG. 1, there is illustrated the split anchor bracket 10 of the present invention wherein the base support portion 12 is affixed to the deck 70 of a boat, such as a power boat or cruiser, utilizing suitable fasteners such as bolts 26. Preferably, the base support 12 is affixed to the deck near the bow of the boat in a position wherein the upper lock portion 14 can be carried by the hand rail 72 or other fixed construction in substantially vertical alignment or registry above the base support 12 to support the boat anchor 58 above the deck 70.

Figure 2:
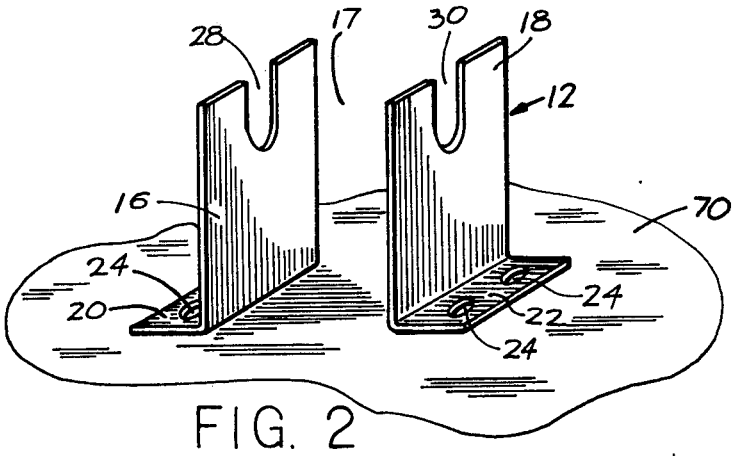
FIG. 2 is a perspective view of the base support.

As illustrated in FIG. 2, the base support 12 is fabricated to a generally channel shaped configuration and includes a pair of upright support legs 16, 18 which are bent at right angles to the attaching flanges 20, 22. The support legs 16, 18 are spaced apart sufficiently to define a stabilizing space 17 therebetween to adequately support the anchor 58 in a stable manner. Each of the support legs 16, 18 is cut, punched or otherwise formed to provide a medial opening or cradle 28, 30, which cradles cooperate to receive therewithin the usual pivot bar 64 of the anchor 58 in a supporting engagement. The cradles 28, 30 are fabricated of suitable width and suitable depth to readily receive the anchor pivot bar 64 in a relatively loose engagement to facilitate placing the anchor therewithin when it is desired to support the anchor 58 above the boat deck 70 in the manner illustrated in FIG. 1. The flanges 20, 22 are drilled or otherwise treated to provide one or more openings 24 of suitable size to receive the attaching bolts 26 or other fasteners to permit secure fastening of the base support 12 to the deck 70 in well-known manner.

Figure 3:
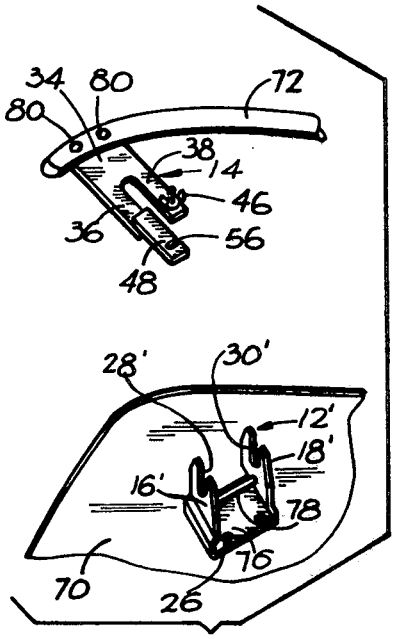
FIG. 3 is a perspective view of a modified base support construction.

In the modified embodiment illustrated in FIG. 3, the base support 12′ is fabricated generally similar to the base support 12 except that a solid web 76 connects the support legs 16′, 18′ to form a sturdy interconnection at the base of the legs. A transverse spacer 78 is positioned in parallel spaced relationship above the web 76 and securely interconnects the support legs 16′, 18′. The base web 76 and spacer 78 cooperate to prevent any relative movement between the support legs 16′, 18′ under all conditions of use. As illustrated, the spacer 78 is affixed between the support legs 16′, 18′ below the lowest extension of the transverse cradles 28′, 30′ so as not to interfere with the function of the cradles. The support 12′ is affixed to the boat deck 70 in conventional manner by utilizing fasteners 26 which are driven through the web 76 to engage the deck 70.

Figure 4:
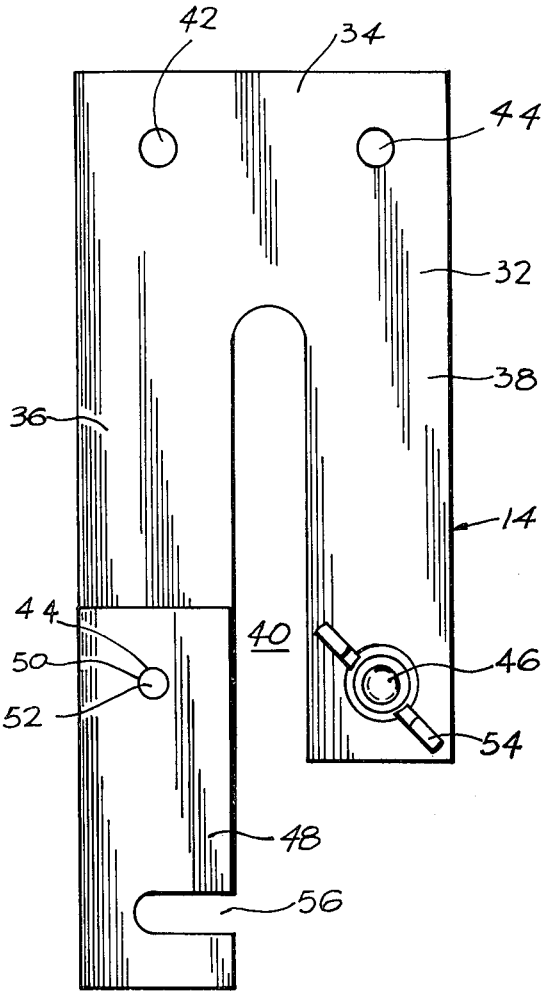
FIG. 4 is a top plan view of the anchor lock with the closure pivoted to the open position.
Figure 5:
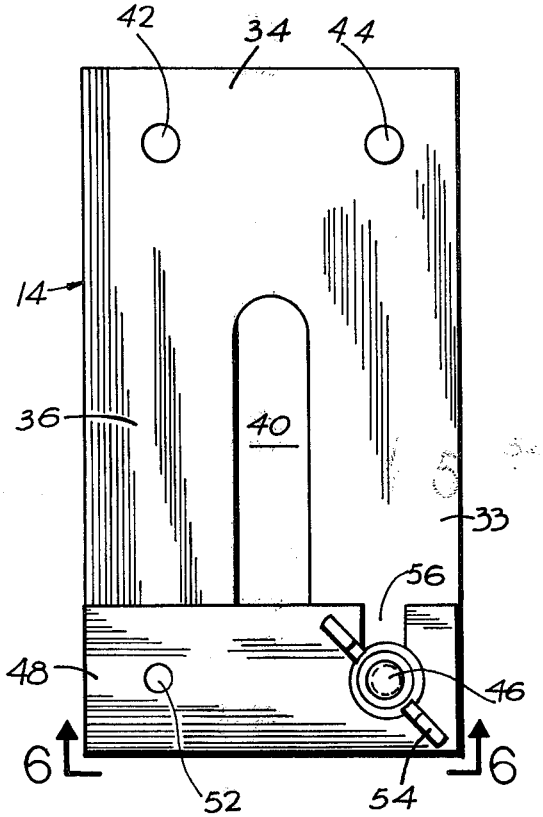
FIG. 5 is a top plan view similar to FIG. 4 showing the closure pivoted to the closed and locked position.
Figure 6:
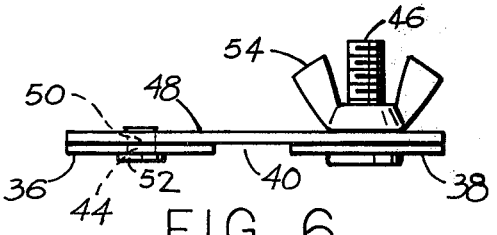
FIG. 6 is an end elevational view looking from Line 6—6 of FIG. 5 in the direction of the arrows.

Referring now the FIGS. 4, 5 and 6, the construction details of the upper lock 14 are the best seen. The upper lock 14 comprises generally a U-shaped body 32 of planar, metallic construction including the forward base 34 and a pair of trailing legs 36, 38, which legs extend rearwardly substantially in registry over the support legs 16, 18 of the base support 12. The legs 36, 38 define an opening or slot 40 therebetween to receive the shank 60 of the anchor 58 in a manner to support the anchor shank in generally vertical alignment.

The upper lock base 34 is drilled or otherwise treated to provide a pair of openings or holes 42, 44 of a suitable size to receive bolts 80 or other suitable fasteners therein when the upper lock 14 is affixed to the hand rail 72 in the manner illustrated in FIG. 1. The bolts 80 insert through the openings 42 to securely affix the upper lock 14 to the handrail 72 in a manner well known to those skilled in the art.

Near the trailing end of one leg 36 is provided another bolt hole or other construction 44 suitable to pivotally receive one end of the closure bar 48. In a preferred embodiment, the closure bar 48 is also drilled or otherwise treated to form a hole 50 which is placed in registry over the hole 44 in the leg 36. A rivet 52, or other suitable construction, can be secured through the aligned holes 44, 50 to permit the closure bar 48 to pivot relative to the upper lock body 32 when it is desired to either lock or unlock the anchor shank within the opening 40.

The other leg 38 near the trailing edge thereof is provided with a threaded stud 46 or other device suitable for closure locking purposes. As illustrated in FIG. 4, the end of the closure bar 48 opposite the end provided with the hole 50 is drilled, punched or otherwise treated to form a forwardly open slot 56 of size and position to engage the threaded stud 46 when the closure bar is pivoted to the locked position, as illustrated in FIG. 5. To maintain the closure bar 48 in the closed and locked position, a wing nut 54 can be threadedly engaged upon the stud 46 to cinch the closure 48 to the upper lock body 32 in well known manner.

In order to use the anchor bracket of the present invention, the base support 12 or 12′ is permanently affixed to the deck 70 of the boat in a conventional manner such as by employing suitable anchoring bolts 26. The upper lock 14 is secured in spaced relationship above the base support 12 in substantially vertical registry thereover. The upper lock bolts 80 may be employed to secure the upper lock 14 to stationary portions of the boat construction above the deck, such as the usual bow rail 72. Optionally, the lock 14 could be welded or otherwise secured in place. If necessary, suitable brackets or other spacing construction may be employed to properly position the upper lock 14 above the base support 12 or 12'.

With the base support 12 or 12' and the upper lock 14 securely bolted in position, the closure bar 48 is pivoted to the open position to expose the upper lock slot 40 in the manner illustrated in FIG. 4. In the usual manner, an anchor rope 74 is affixed between a fixed portion of the boat and ring 68 of the anchor 58. By pulling on the anchor rope 74, the anchor 58 can be pulled from the water (not illustrated) to a position above the deck 70. The anchor pivot bar 64 can then be directed into the cradles 28, 30 in a manner to suspend the anchor flukes 62, the crown 66 and the shank 60 above the deck 70. Once the pivot bar 64 has been positioned within the spaced cradles 28, 30, the shank 60 can be readily urged into the locking slot or opening 40 of the upper lock body 32. After the shank 60 is fully seated within the slot 40, the closure bar 48 is pivoted about the pivot 52 until the closure bar slot 56 is fully engaged upon the threaded stud 46. With the parts so positioned, a wing nut 54 or other threaded member is threadedly turned upon the stud 46 until the closure bar 48 is tightly engaged upon the upper lock body 32, thereby to lock the anchor shank within the upper lock slot 40. See FIG. 1. Thus, the boat anchor 58 can be easily and safely supported above the deck 70 in a manner requiring a minimum amount of deck space and with adequate clearance to facilitate additional clear deck space, deck washing and other useful purposes.

Although the invention has been described with a certain degree of particularity, it is understood that the present disclosure has been made only by way of example and that numerous changes in the details of construction and the combination and arrangement of parts may be resorted to without departing from the spirit and scope of the invention as hereinafter claimed.

I claim:

1. In an anchor bracket for supporting an anchor including a shank, a pivot bar and flukes above the deck of a boat, the combination of base support means to support the anchor, said base support means comprising at least one support leg adapted to receive a first part of the anchor, said support leg including a body extending above the deck, said body being upwardly formed to provide a cradle, said cradle being spaced above the deck and being configured to receive and support the anchor pivot bar in spaced relationship above the deck; and lock means affixed above the base support means to engage the shank part of the anchor, said lock means being adapted to support the shank in substantially vertical position, at least a part of the lock means being affixed in substantial vertical registry above at least a part of the base support means, the lock means comprising a body having a base and a pair of lock legs extending from the base, the lock legs defining a slot therebetween, the slot being adapted to receive and retain a portion of the anchor shank therewithin to support the shank in substantially vertical relationship above the deck, the lock means further comprising a movable closure to selectively enclose the slot, said movable closure being adapted to lock the anchor shank within the said slot, whereby the anchor can be secured above the deck.

2. The anchor bracket according to claim 1 wherein the movable closure comprises pivotal means to pivotally move the movable closure relative to the body, the pivotal means being pivotally affixed to one of said lock legs and removably affixed to the other of said lock legs and lock means to secure the movable closure to the other of said lock legs whereby the anchor shank can be releasably locked within the slot.

3. An anchor bracket for supporting above the deck of a boat an anchor of the type including a shank, a pivot bar and flukes attached to the pivot bar comprising base support means secured to the deck, the base support means comprising a pair of spaced support legs extending above the deck, the support legs being upwardly formed to provide spaced cradles, the cradles being spaced above the deck and being configured to receive and carry therewithin the said pivot bar to support the anchor pivot bar and flukes above the deck, said support means being in stationary relationship to the deck; and lock means secured to the boat in substantial vertical registry above the base support means adapted to engage the shank and secure the shank in substantial vertical position above the deck, the lock means including a slot adapted to receive a portion of the shank therewithin, the slot including a closed bottom and a top opening, the opening being of suitable dimensions to removably receive the said shank portion, and a closure adapted to selectively close the slot opening to secure the shank portion therewithin, whereby the anchor can be secured above the deck with the shank in substantially vertical orientation.

4. The anchor bracket of claim 3 wherein the lock means comprises a pair of lock legs, the lock legs being joined at one end to define the bottom of said slot and being spaced at their other ends to define the said top opening.

5. The anchor bracket of claim 4 wherein the lock means comprises a movable closure to close the slot, the closure being movably secured to one of the said lock legs in position to contact the other of said lock legs.

* * * * *